United States Patent [19]

Nims

[11] 4,168,038

[45] Sep. 18, 1979

[54] TAPE REROLL APPARATUS

[76] Inventor: Robert W. Nims, 510 N. Kinney, Mt. Pleasant, Mich. 48858

[21] Appl. No.: 843,563

[22] Filed: Oct. 19, 1977

[51] Int. Cl.[2] ..... B65H 17/18; B65H 21/00; B65H 23/10

[52] U.S. Cl. ..... 242/56 R; 156/502; 400/614; 400/621; 242/58.1; 242/67.3 R; 242/75.2; 400/617

[58] Field of Search ..... 242/67.3 R, 67.1 R, 242/68.4, 58.1, 75.2, 56 R; 197/133 A, 133 R, 180; 156/502, 510; 235/58 CF

[56] References Cited

U.S. PATENT DOCUMENTS

| | | | |
|---|---|---|---|
| 1,436,218 | 11/1922 | Tindall et al. | 242/67.3 R |
| 1,604,794 | 10/1926 | Sutton | 242/67.3 R |
| 1,702,971 | 2/1929 | Jeffress | 242/68.4 X |
| 1,829,727 | 11/1931 | Barrett | 242/67.3 R |
| 1,957,203 | 5/1934 | Eichenauer | 235/58 CF X |
| 2,352,279 | 6/1944 | Mehan | 242/55.2 |
| 2,565,009 | 8/1951 | Wallingsford | 242/58.1 X |
| 3,025,014 | 3/1962 | Casey | 242/67.3 R |
| 3,733,230 | 5/1973 | Prittie | 242/58.1 X |
| 4,014,426 | 3/1977 | Neufeld | 242/68.4 X |
| 4,065,068 | 12/1977 | Treadwell | 242/75.2 X |

FOREIGN PATENT DOCUMENTS

| | | | |
|---|---|---|---|
| 530569 | 3/1955 | Switzerland | 242/67.3 R |

*Primary Examiner*—Harvey C. Hornsby
*Assistant Examiner*—John M. Jillions
*Attorney, Agent, or Firm*—Basile and Weintraub

[57] ABSTRACT

An apparatus for attachment to a recording machine of the type in which a printed record is made on a continuous strip of paper, such as a paper tape, traveling over a rotating platen wherein the tape is fed into the machine from a tape roll. The apparatus comprises a support frame having a pair of laterally spaced frame members which are interconnected in such a manner that the distance between the members may be selectively adjusted to accommodate tapes of varying widths. The frame members have spaced spindles which mount a feed roll that supplies the paper tape to the recorder machine, while a second pair of spaced spindles are carried by the frame members for rotatably mounting a take-up reel. The end of the tape passing through the recording machine is attached to the take-up reel in such a manner that the tape may be rewound thereon. Means carried by the frame members bias the take-up reel and the feed roll toward one another such that as tape is withdrawn from the feed roll, the frictional engagement with the take-up reel rotates the same in such a manner that the tape leaving the recording machine may be rewound for reuse. In one embodiment of the invention means are provided for selectively cutting and/or splicing the paper tape after it leaves the recording machine.

2 Claims, 9 Drawing Figures

TAPE REROLL APPARATUS

BACKGROUND OF THE INVENTION

I. Field of the Invention

The present invention relates to an apparatus for attachment to recording machines and, in particular, to an apparatus for rewinding a continuous strip of paper after the same leaves the recording machine.

II. Description of the Prior Art

Recording machines and, in particular, adding machines are now made to carry a spool on which is wound a strip of continuous paper. The lead end of the strip of paper passes around the platen of the adding machine whereupon indicia or the like is imprinted on one surface of the strip of paper. It is customary that the strip of paper is torn off after the record has been completed. An example of such an adding machine is disclosed in U.S. Pat. No. 2,352,279. In certain classes of work it is desired to have a recording machine which records a series of items on a continuous list and at the same time enters each item upon a separate sheet. The continuous list is prepared in the manner usual in tabulating machines, while the separate sheets are presented to the printing position to receive a printed impression simultaneously with the continuous list. It has been known that this secondary imprinting may also be printed on a continuous list. Examples of such apparatuses are disclosed in U.S. Pat. No. 1,957,203 wherein the paper tape carried in the machine is fed through the adding machine and stored on a pick-up reel. This machine functions in a manner similar to well-known and conventionally used registers wherein it is desired to provide a receipt to the purchasing party while maintaining a record of the purchases.

U.S. Pat. No. 1,436,218 discloses an attachment for an adding machine comprising a pair of L-shaped brackets which are designed to mount a supply roll of continuous tape and a take-up reel for receiving the take-up tape after it has been fed through the adding machine and a record imprinted thereon. The take-up reel is attached to the adding machine itself and is driven through a belt pulley arrangement such that during activation of the machine the pulley arrangement winds the take-up reel which, in turn, will cause the supply reel to unwind.

Apparatuses of the prior art structures for rewinding the paper tape are either of the type which form an integral part of the machine or which must be mechanically connected to the operative parts of the recording machine in order to drive the take-up reel.

It is desirable to provide an apparatus which mounts a feed roll and a take-up reel which may be used in conjunction with a variety of recording devices and, in particular, in conjunction with adding machines without the necessity of modifying the adding machine or having the apparatus made an integral part of the machine.

III. Prior Art Statement

In the opinion of the applicant the aforementioned patents represent the closest prior art of which the applicant is aware.

SUMMARY OF THE INVENTION

The present invention, which will be described subsequently in greater detail, comprises an attachment for a recording machine of the type which utilizes a continuous strip of paper tape traveling over a rotating platen for the purpose of recording information on one surface thereof and wherein the apparatus includes means for mounting a feed roll and a take-up reel and wherein the strip of paper carried by the feed roll is fed into the recording machine and returned for rewinding on the take-up reel which, in turn, is driven through a frictional engagement with the feed roll.

It is therefore a primary object of the present invention to provide an apparatus of the type described herein which will facilitate the rewinding of a continuous strip of paper traveling through a recording machine.

It is a further object of the present invention to provide such an apparatus which does not require any modification of the recording machine or attachment thereto.

It is a further object of the present invention to provide an apparatus of the type described herein having a novel and useful means for cutting and/or splicing strips of paper so as to permit the removal of certain sections of paper from the continuous strip and to permit the rewinding of the remainder of the strip of paper.

It is a further object of the present invention to provide an apparatus of the type described herein which is of a simple design and, thus, one which is inexpensive to manufacture and reliable in use.

Other objects, advantages and applications of the present invention will become apparent to those skilled in the art of apparatuses for feeding continuous paper strips through a recording machine and for the rewinding of such strips after recordation when the accompanying description of several examples of the best modes contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENTS

Figure 1:
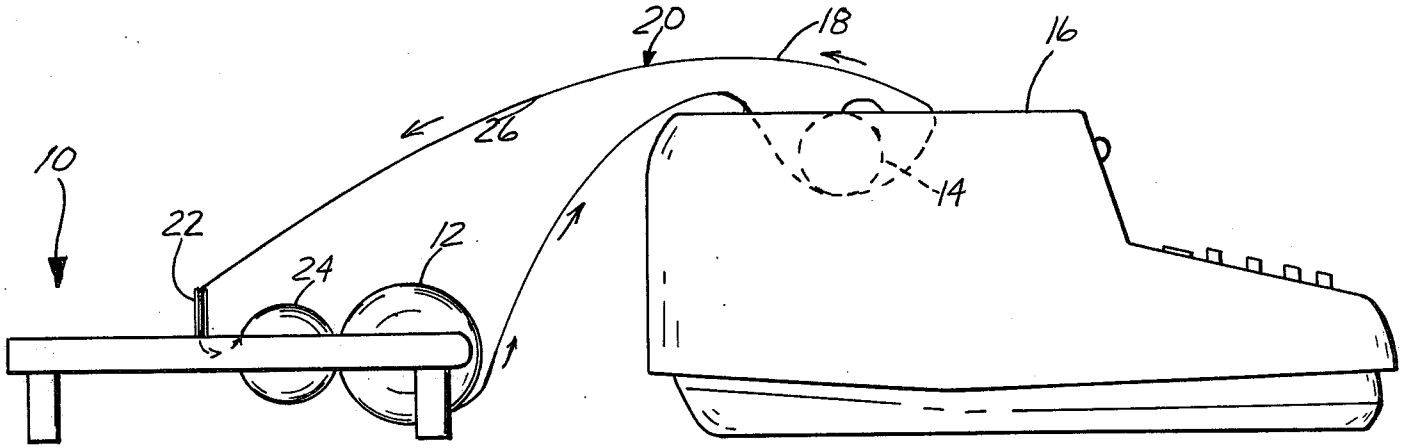
FIG. 1 is a side elevational view of an adding machine utilizing a tape reroll apparatus constructed in accordance with the principles of the present invention.

Referring now to the drawings and, in particular, to FIG. 1 wherein there is illustrated one example of the present invention in the form of a tape reroll apparatus 10 which has a feed roll 12 consisting of a continuous strip of paper tape 20 which is adapted to travel over a platen 14 of a recording machine, such as the adding machine 16, whereupon suitable indicia is recorded on the outer, exposed surface 18 of the paper tape 20. The tape 20 is then fed through a cutter and tension device 22 for rewinding on a take-up reel 24. It should be noted in FIG. 1 that when the tape 20 is rewound, the outer surface 18 is wound on the take-up reel 24 in such a manner that it is reversed from its original position on the feed roll 12; that is, the opposite surface 26 is now in position so that the rewound roll of tape may be reused and indicia printed on the surface 26, thereby facilitating the economical use of both sides of the feed roll 12.

Figure 2:
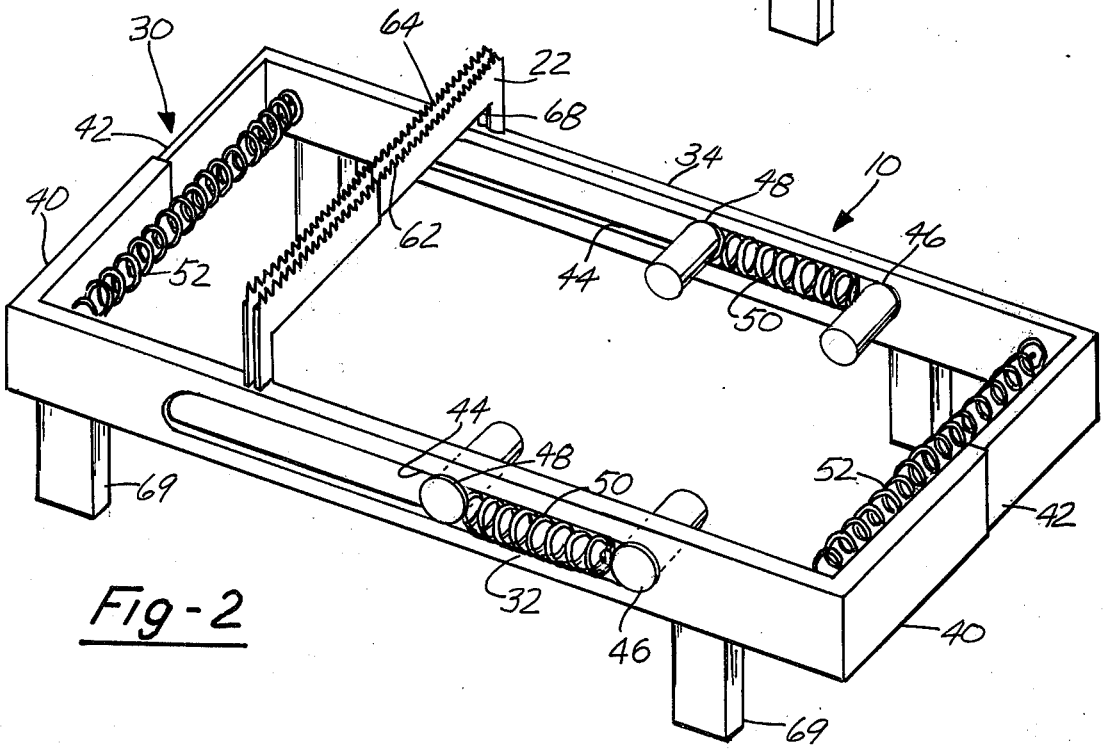
FIG. 2 is a perspective view of one example of a tape roll apparatus.

Referring now to FIG. 2 for a more detailed description of one example of the present invention, the apparatus 10 is illustrated as comprising a support frame 30 having a pair of parallel, laterally spaced frame members 32 and 34, the opposite ends of each having right-angled legs 40 and 42, respectively. As can be seen in FIG. 2, the legs 40 of the support member 32 are hollowed and telescopically receive the legs 42 of the support member 34 such that the distance between the support members 32 and 34 may be selectively varied so as to accommodate tape feed rolls 12 of varying widths. Each of the frame members 32 and 34 has a longitudinal slot 44 which slideably supports rear spindles 48. A forward spindle 46 is designed to rotatably support the feed tape roll 12, while the rear spindles 48 rotatably support the take-up reel 24. A compression coil spring 50 functions to bias the spindles 46 and 48 toward one another such that when the spindles 46 and 48 rotatably mount, respectively, the feed roll 12 and the take-up reel 24, the two are brought into a frictional engagement such that rotation of the feed roll 12, when the strip of paper tape 20 is withdrawn therefrom, will induce a rotational movement of the take-up reel 24. Specifically, as seen in FIG. 1, when the feed roll 12 is rotated in a counter-clockwise direction so as to unravel, the take-up reel 24 is rotated in a clockwise direction so as to wind up the used strip of paper tape 20.

A pair of compression coil springs 52 disposed at opposite longitudinal ends of the frame 30 are suitably attached to the frame members 32 and 34 so as to bias them towards each other and maintain the spindles 46 and 48, respectively, rotatably engaged with the feed roll 12 and the take-up reel 24. As aforementioned, the apparatus 10 includes a telescopically engaging cutter device 22 which includes a serrated top section 62 that facilitates the tearing of the strip of paper tape 20 when it is necessary to separate sections thereof. The paper tape 20 is normally inserted between the spaced members 64 and 68 which define the cutting device 22 so as to provide a certain amount of tension acting on the strip of paper tape 20 to facilitate the frictional engagement between the take-up reel 24 and the feed roll 12 and, thus, insure a smooth, continuous windup of the used portion of the strip of paper tape 20. The apparatus 10 further comprises a plurality of upright leg members 69 which provide a suitable support for the frame 30 to elevate the frame members 32 and 34 a sufficient distance above the supporting surface so that the roll 12 and reel 24 do not come into contact with the supporting surface during operation of the machine 16.

Figure 3:
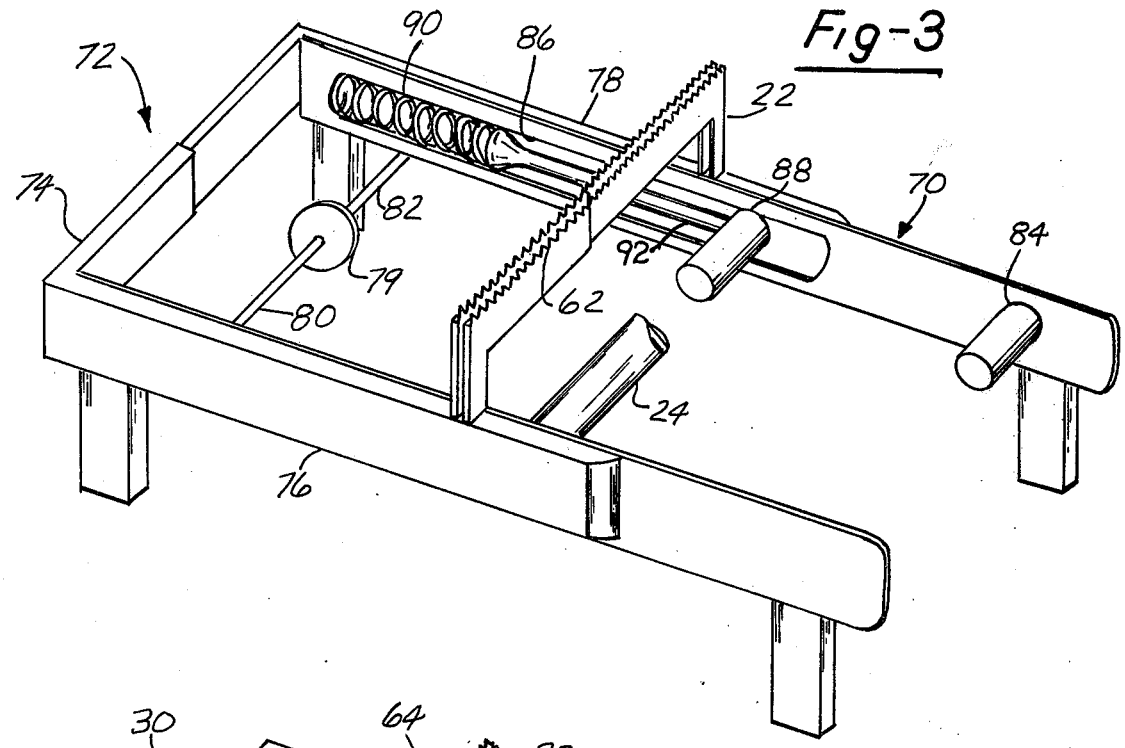
FIG. 3 is a second example of a tape roll apparatus.

Referring now to FIG. 3 for a detailed description of a second embodiment of the present invention in the form of a tape reroll apparatus 70 that comprises a U-shaped frame member 72 having a telescopically engaging base 74 which permits its longitudinal leg members 76 and 78 to be moved toward and away from one another so as to adjust the distance between the two members 76 and 78 to accommodate the mounting of paper tape rolls 12 of varying widths. A rotatably threaded member 79 has a hollow stem 80 attached to the leg member 76 and threadingly engages a second threaded member 82 attached to the leg member 78 such that rotation of the member 79 in one direction threadingly receives the threaded member 82 into the hollow stem 80 so as to draw the members 76 and 78 closer to one another. Rotation of the threaded member 79 in the opposite direction results in the separation of the frame members 76 and 78, thus providing a simple means for varying the distance between the two frame members 76 and 78. The frame members 76 and 78 each support at the forward ends thereof a stationary spindle 84 which rotatably supports the roll 12 in a manner similar to the spindles 46 described with respect to the embodiment illustrated in FIG. 2 of the drawings. Each of the frame members 76 and 78 has an inner longitudinal slot 86 (only one is illustrated) which slideably supports a pair of spindles 88 which, in turn, are adapted to rotatably support the take-up reel 24. The longitudinal slots 86 further support compression springs 90, each of which has one end bearing against the end of the slot 86, while the other spring end bears against a transmission rod 92. The transmission rod 92 exerts a force against the spindle 88 biasing it and, thus, the take-up reel 24 toward the roll 12 to provide a simple means for causing a frictional engagement between the roll 12 and the reel 24 to achieve the aforementioned winding up of the used tape 20 onto the take-up reel 24 as the roll 12 is unraveled.

The apparatus 70 further comprises a telescopically disposed cutter 22 which has been described hereinbefore with respect to the embodiment illustrated in FIG. 2 of the drawings.

Figure 6:
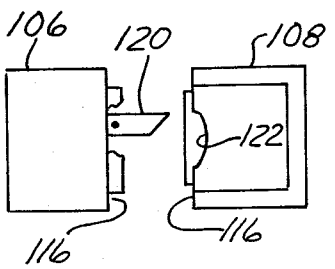
FIG. 6 is a fragmentary, sectional view of the tape cutter and splicer taken generally along Line 6—6 of FIG. 4.
Figure 5:
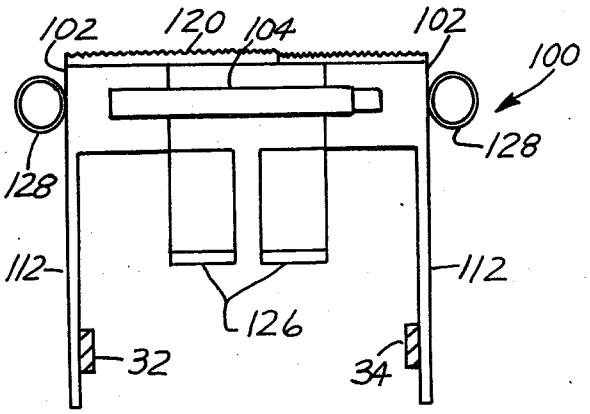
FIG. 5 is a front elevational view of the tape cutter and splicer illustrated in FIG. 4 of the drawings.
Figure 4:
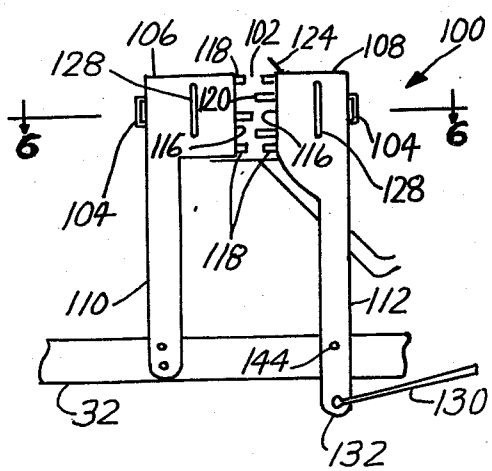
FIG. 4 is a side elevational view of a tape cutter and splicing device which may be utilized in conjunction with the tape roll apparatus illustrated in FIGS. 1 through 3 of the drawings.

Referring now to FIGS. 4, 5 and 6, there is illustrated one example of a cutter and splicing device 100 which is adapted for use on the several embodiments of the invention described hereinbefore. The cutter and splicer device 100 comprises a pair of laterally spaced splicer mechanisms 102 which are joined to each other by telescopic channel members 104. This permits the two laterally spaced splicing mechanisms 102 to be moved with the frame members to accommodate the reception of rolls 12 of varying widths.

As can best be seen in FIG. 4, each of the splicer mechanisms 102 has a pair of heads 106 and 108 which are adapted to be brought into close proximity to one another to achieve a splicing of two ends of a paper tape 20, as will be explained hereinafter. Each head 106 is mounted to a vertical, stationary arm support 110 having its lower end securely fastened to the outside of a frame member, such as the frame member 32 in the embodiment illustrated in FIG. 2 of the drawings or the frame member 76 in the embodiment of the invention illustrated in FIG. 3 of the drawings. For purposes of description, reference shall be made to the apparatus 10 illustrated in FIG. 2 of the drawings; however, it should be understood that applicant's comments with respect to the mounting and use of the inventive splicer 100 has equal application to both embodiments of the invention. The splicer heads 108 each have downwardly extending support arms 112 which are pivotally attached at 144 to the outside surface of the frame member 32. It can be seen that this arrangement permits the heads 108 to be rotated about the pivot point 144 toward and away from the heads 106. The opposing inner faces 116 of the heads 106 and 108 are provided with paper engaging pads 118 which function to grasp the paper disposed thereinbetween and hold the same in place during the splicing operation. Splicing occurs by means of a plurality of opposing teeth 120 carried by the heads 106 and 108.

As can best be seen in FIG. 6, when the splicing heads 106 and 108 are brought into contact with one another, the splicing teeth 120 cut through the paper and engage a cam surface 122 formed on the opposing head so as to force teeth 120 to follow the cam surface 122, folding the paper over. Since the teeth are disposed on opposite ends of the splicer 100, the splicing of the tape 20 generally occurs on or near the edges of the paper, all of which permits the user of applicant's invention to cut the paper tape at a desired location, separate the same from the tape 20, and then join the remaining sections of the tape 20 so as to continue rerolling the tape 20 for subsequent reuse. The top portion of the splicer 100 includes a telescopically engaging cutter 124 which facilitates the cutting of the paper as desired. The lower portion of the head 108 on each splicer 102 carries a pair of opposing plate members 126 which function to slideably receive the paper tape 20 so as to guide it appropriately through the splicer as well as to provide a suitable tension thereto to facilitate the rewinding of the tape on the take-up reel 24. Finger grips 128 permit the user to conveniently grasp the splicer 100 and perform the aforementioned splicing operation.

The lower end of the movable arm 112 carries a connecting member 130 which couples the arm end 132 to the take-up reel 24 to move it away from the feed roll 12 and thereby selectively terminate the frictional drive.

Figure 7:
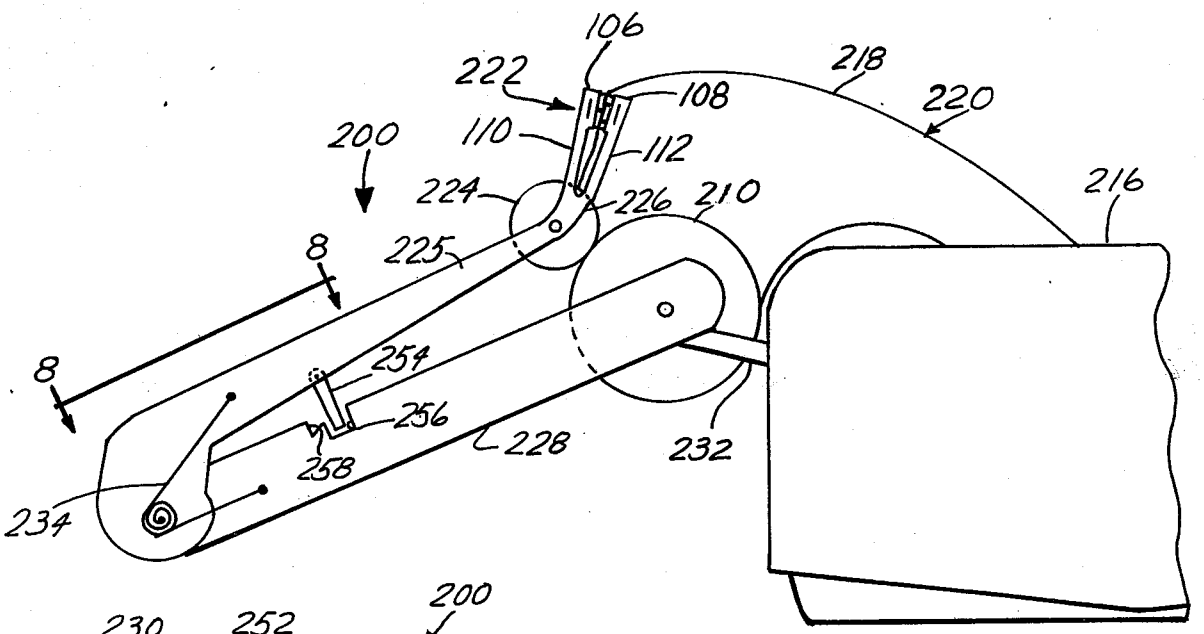
FIG. 7 is a side elevational view of an adding machine utilizing a third example of a tape roll apparatus.
Figure 9:
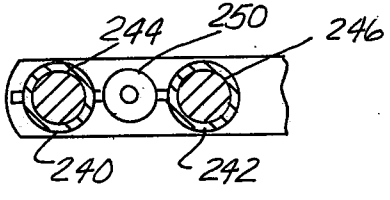
FIG. 9 is a fragmentary, cross-sectional view taken along Line 9—9 of FIG. 8.
Figure 8:
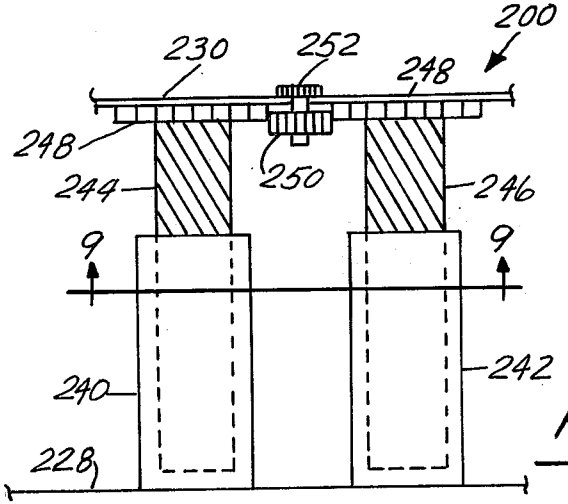
FIG. 8 is a fragmentary, elevational view of the tape roll apparatus taken along Line 8—8 of FIG. 7.

Referring now to FIGS. 7, 8 and 9, there is illustrated another example of the present invention in the form of a tape roll apparatus 200 which has a feed roll 210 consisting of a continuous strip of paper 220 which is adapted to travel over the platen of a recording machine, such as the adding machine 216, whereupon suitable indicia is recorded on the outer exposed surface 218 of the paper tape 220. The tape 220 is then fed through a cutter and splicing device 222 for rewinding on a take-up reel 224. The cutter and splicing device 222 is substantially the same as the cutter and splicing device 100 described hereinbefore, the difference being in the manner in which the splicer 222 is attached to the reroll apparatus 200. Since the cutting and splicing device 222 is substantially identical to the splicing device 100, like components are identified by like numerals. In the instant case the legs 110 of the splicer 222 are attached to the cantilevered end of arm members 225, while the legs 112 of the splicer 222 are pivotally attached to the arm members 225, as at 226. This permits the legs 112 to be pivoted with respect to the legs 110 such that the opposing heads 106 and 108 will engage each other in the same manner described with respect to the cutter and splicing device illustrated in FIGS. 4 through 6 of the drawings. The tape reroll apparatus 200 further comprises a pair of laterally spaced frame members 228 and 230, each of which has spindles (not shown) at their right end and which engage the feed roll 210 to support the same and to provide a means for attachment to the arm 232 of the adding machine 216 such that the feed roll 210 and the tape reroll apparatus 200 may be supported in the position illustrated. The lower or left end of the frame members 228 and 230 each pivotally support the laterally spaced arm members 225, while a spring 234 suitably attached to the frame members 228 and 230 and the arm members 225 biases the arm members 225 toward the frame members 228 and 230 in a scissors-like manner. Thus, the take-up reel 224 is constantly biased into engagement with the feed roll 210 such that rotational movement of the feed roll 210 will rotate the take-up reel 224 and whereby the paper tape 220 is rewound in the same manner as described with respect to the aforementioned embodiments of applicant's inventive tape reroll apparatus. The take-up reel 224 is rotatably carried at the ends of the arm members 225.

As can best be seen in FIGS. 8 and 9, the frame members 228 and 230 are connected by a pair of telescopic tubes 240 and 242 such that the lateral distance between the frame members 228 and 230 may be selectively varied to provide a simple means for accommodating tape feed rolls 210 of varying widths. It can be seen that the telescopic tubes 240 and 242 threadingly receive members 244 and 246, respectively. These members, in turn, are carried by gear arrangements 248 that are engaged by a drive gear 250 which, in turn, is rotatable by a knob 252 carried externally of the frame member 230. It can be seen that rotation of the knob 252 drives the gears 248 so as to thread the members 244 and 246 into the telescopic tubes 240 and 242, respectively, thereby moving the frame members 228 and 230 toward and away from each other as desired. It should be noted that the threads on the member 244 are left-handed threads, while the threads on the member 246 are right-handed threads so that both members move in and out in a synchronized manner.

It can be seen that the frictional engagement between the take-up reel 224 and the feed roll 210 may be interrupted simply by lifting the arm members 225 upwardly against the bias of the spring 234, that is, rotating the arm members 225 in a counterclockwise direction, as viewed in FIG. 7. Pivoting the support peg 254 from the recess 256 to the recess 258 will prevent the take-up reel 224 from engaging the feed roll 210.

It can thus be seen that applicant's invention has provided a new and approved apparatus which greatly facilitates the unwinding and winding of paper strips of tape on which indicia is recorded and wherein the tape is rewound in such a manner that both sides of the tape may be used, thus providing for a more efficient use of materials.

It should be apparent to those skilled in the art of tape reroll apparatuses that other forms of applicant's invention may be had, all coming within the spirit of the invention and scope of the appended claims.

What is claimed is as follows:

1. An apparatus for use in conjunction with a recording machine of the type in which printed record is made on a continuous strip of paper traveling over a rotating platen of the recording machine and wherein said attachment functions to rewind the tape for reuse, said attachment comprising:

a support frame supported on a surface proximate the machine having a pair of laterally spaced frame members the distance between which is selectively variable to accommodate tape rolls of varying width;

first means for rotatably supporting said roll of tape such that the lead end of said tape may be fed into said machine platen, said roll being rotated as said machine platen draws said tape therein;

a take-up reel;

second means for rotatably supporting said take-up reel such that it is adapted to receive and rewind the strip of paper passing from said machine;

means biasing said roll and said reel into frictional engagement such that said paper tape roll rotates said take-up reel to facilitate the rewinding of said tape thereon;

said first means for rotatably supporting said roll of paper tape comprises;

a pair of laterally spaced spindles, slidably supported in each of said frame members; said second means for rotatably supporting said take-up reel comprising a pair of laterally spaced spindles slidably disposed in each of said frame members; and said biasing means comprising a pair of springs disposed between said spindles in said frame members and attached to said spindles to bias them toward one another;

a cutter device for selectively cutting the tape comprising telescopingly engaging spaced members with serrated top extending between frame members for passing the tape therebetween said spaced members providing tension inducing friction between the take-up reel and feed roll;

a tape splicing device for splicing the ends of tapes together comprising a pair of spaced apart heads adapted to allow overlapping ends of tape to be spliced to be placed therebetween, a pair of opposing inner faces on the heads provided with paper engaging pads to grasp the paper therebetween, a plurality of opposed teeth carried by the inner faces to cut through the paper, said teeth engaging a cam surface formed on the opposing head, the teeth as the heads come together following the cam surface and folding the paper over to form a splice.

2. The apparatus defined in claim 1 wherein said first means for rotatably supporting said roll of tape comprises:

a spindle fixedly carried on each of said frame members and adapted to rotatably support said feed roll thereinbetween;

a slot disposed in each of said frame members, said second means comprising a pair of laterally spaced spindles slidably disposed in said slots; and spring means disposed in said slots for exerting a biasing force against said last-mentioned spindles to bias them towards said first-mentioned spindles.

* * * * *